US008117767B2

(12) United States Patent
Ercoli

(10) Patent No.: US 8,117,767 B2
(45) Date of Patent: Feb. 21, 2012

(54) ROTATING ANTI-SLIP DEVICE FOR SOLES FOR FOOTWEAR

(75) Inventor: Germano Ercoli, Civitanova Marche (IT)

(73) Assignee: Eurosuole S.p.A., Civitanova Marche (MC) (IT)

( * ) Notice: Subject to any disclaimer, the term of this patent is extended or adjusted under 35 U.S.C. 154(b) by 763 days.

(21) Appl. No.: 12/281,322

(22) PCT Filed: Sep. 25, 2007

(86) PCT No.: PCT/EP2007/008321

§ 371 (c)(1),
(2), (4) Date: Aug. 30, 2008

(87) PCT Pub. No.: WO2008/046491

PCT Pub. Date: Apr. 24, 2008

(65) Prior Publication Data

US 2009/0064537 A1 Mar. 12, 2009

(30) Foreign Application Priority Data

Oct. 20, 2006 (IT) ..... MC2006A0136

(51) Int. Cl.
*A43C 15/14* (2006.01)

(52) U.S. Cl. ..... 36/61; 36/65

(58) Field of Classification Search ..... 36/61, 65, 36/64, 66

See application file for complete search history.

(56) References Cited

U.S. PATENT DOCUMENTS

| | | | | | |
|---|---|---|---|---|---|
| 114,998 | A * | 5/1871 | Warne | 36/65 |
| 512,608 | A * | 1/1894 | Foy | 36/61 |
| 1,047,716 | A * | 12/1912 | Sperling | 36/61 |
| 1,374,418 | A * | 4/1921 | Becker | 36/64 |
| 1,823,612 | A * | 9/1931 | Krebs | 36/64 |
| 3,343,283 | A * | 9/1967 | Henry et al. | 36/61 |
| 5,937,547 | A * | 8/1999 | Abbey | 36/134 |
| 2004/0035024 | A1 * | 2/2004 | Kao | 36/61 |

* cited by examiner

*Primary Examiner* — Ted Kavanaugh
(74) *Attorney, Agent, or Firm* — Egbert Law Offices PLLC

(57) ABSTRACT

The present invention relates to the footwear industry. More specifically, the present invention concerns a device that, inserted in soles for footwear, allows the user to equip his or her own footwear, mechanically and easily, with anti-slip serrated nails in the presence of snow or ice or other slippery material on the paved surface.

7 Claims, 7 Drawing Sheets

Fig. 7
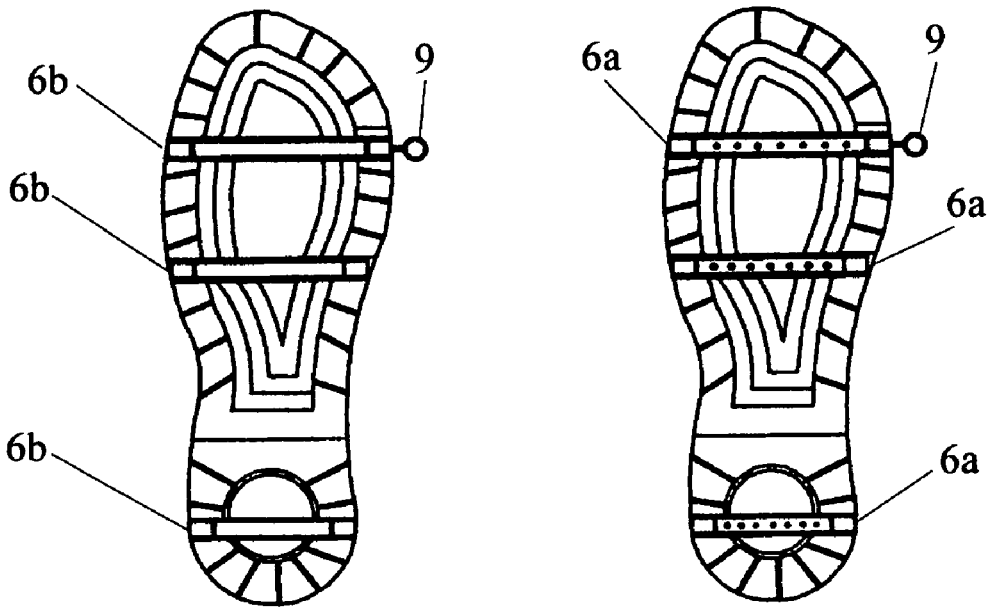
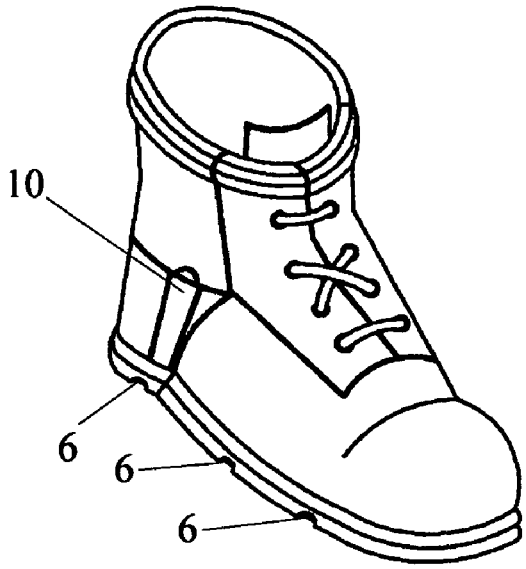
Fig. 8

ROTATING ANTI-SLIP DEVICE FOR SOLES FOR FOOTWEAR

The present invention relates to the footwear industry and more specifically concerns a device that, inserted in soles for footwear, allows the user to equip his or her own footwear, mechanically and easily, with anti-slip serrated nails in the presence of snow or ice or other slippery material on the paved surface. It is well known that in the presence of ice or snow on a paved surface it is easy to slip, with the possibility of causing physical damage to the person, which, especially for certain people or in certain circumstances, may prove very serious.

In mountain areas or in those characterized by long, harsh winters, a technical shoe equipped with nails has been used for a long time. Because of its structure, this cannot, however, be used as a normal shoe and is not compatible with the normal use of a shoe.

To avoid this drawback, nailed shoes are usually replaced by normal footwear to which sealskin or similar coverings, or removable rubber cleats, are applied; these are equipped with spikes or a certain number of nails.

This solution has the disadvantage that the user is obliged to remove the cleat from the shoes whenever he or she has to go into the house or into a building, so as to avoid the nails or the spikes damaging the floors.

This operation is inconvenient in itself, but it also has the disadvantage for the user who has to carry the cleats in order to put them on again later, and these will be dirty from the material collected on them.

Recently, in order to avoid these drawbacks, an application for International Patent No. PCT/IT1999/000232, published with No. WO/2000/004803, was made, for a sole equipped with a system of spikes or nails that, characterised by a 180° rotating movement, can be used in cases where the paved surface is covered in snow or ice and, vice versa, can be retracted manually and slide out of sight into channels provided in the sole, if the pavement is not icy or covered in snow.

This solution has the disadvantage that the rotating operation of the nails or of the spikes seems difficult for the user because of the necessary prior removal of the debris of mud or earth that have collected in the channels in the sole that are designed to house the anti-slip system.

Finally, there is on the market a device that allows a band fitted with spikes or nails to be tilted over mechanically.

The above invention presents serious difficulties in embodiment because the mechanical device, inserted inside the sole, makes the shoe heavy and uncomfortable for ordinary use.

The object of the present invention is to eliminate the disadvantages described above by producing a rotating device incorporated in a sole for footwear and equipped with two parts: a smooth one turned towards the ground in the presence of normal weather conditions and a nailed one that, with the simple use of a small key, is mechanically rotated towards the ground when it is covered with snow or ice.

Another object of the present invention is to allow the user to carry out the mechanical operations of inserting and retracting the anti-slip nails at any time extremely easily without any problems deriving from the necessary advance cleaning of the channels that house the nailed spikes.

Another object of the present invention is to allow the user to be able to pass from a anti-slip shoe to a normal shoe or vice versa with a functional device that does not make the shoe heavy, thus guaranteeing the comfort of the user. These and other objects are achieved by the invention that is the subject of the present application, which concerns a anti-slip device fixed into the sole of a shoe by means of two female-threaded metal inserts, whose function is to fix two lateral supports with a profile corresponding with that of the sole to which a rotating element is screwed, having two parts: one smooth with a profile corresponding with that of the sole that will be turned towards the paved surface if this is not covered by snow or ice; the other part, fitted with nails that are mechanically turned towards the ground, protruding from the profile of the sole enough to ensure the gripping, anti-slip effect required in the presence of ice or snow on the paved surface. The mechanical rotation of the rotating element in relation to its two side anchoring supports is easily carried out with a key and without the user having to dirty his or her hands or have problems with cleaning various channels.

Further characteristics and advantages of the invention will be shown in more details in the description of an embodiment, preferred but not exclusive to this application, illustrated merely as a non-limiting example in the set of drawings in which.

Figure 1:
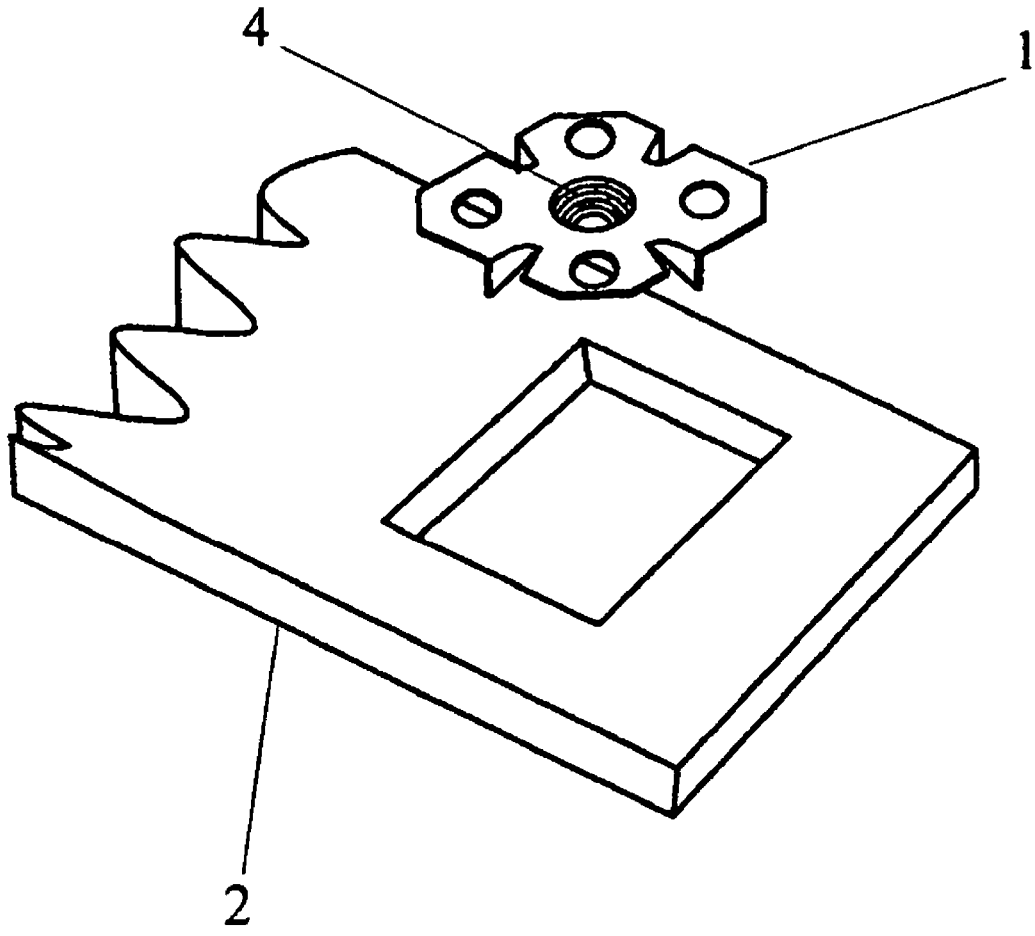
FIG. 1 is a view from above of the female-threaded insert (1), two for each rotating element (6), before it is inserted into the base (2) of the sole.
Figure 2:
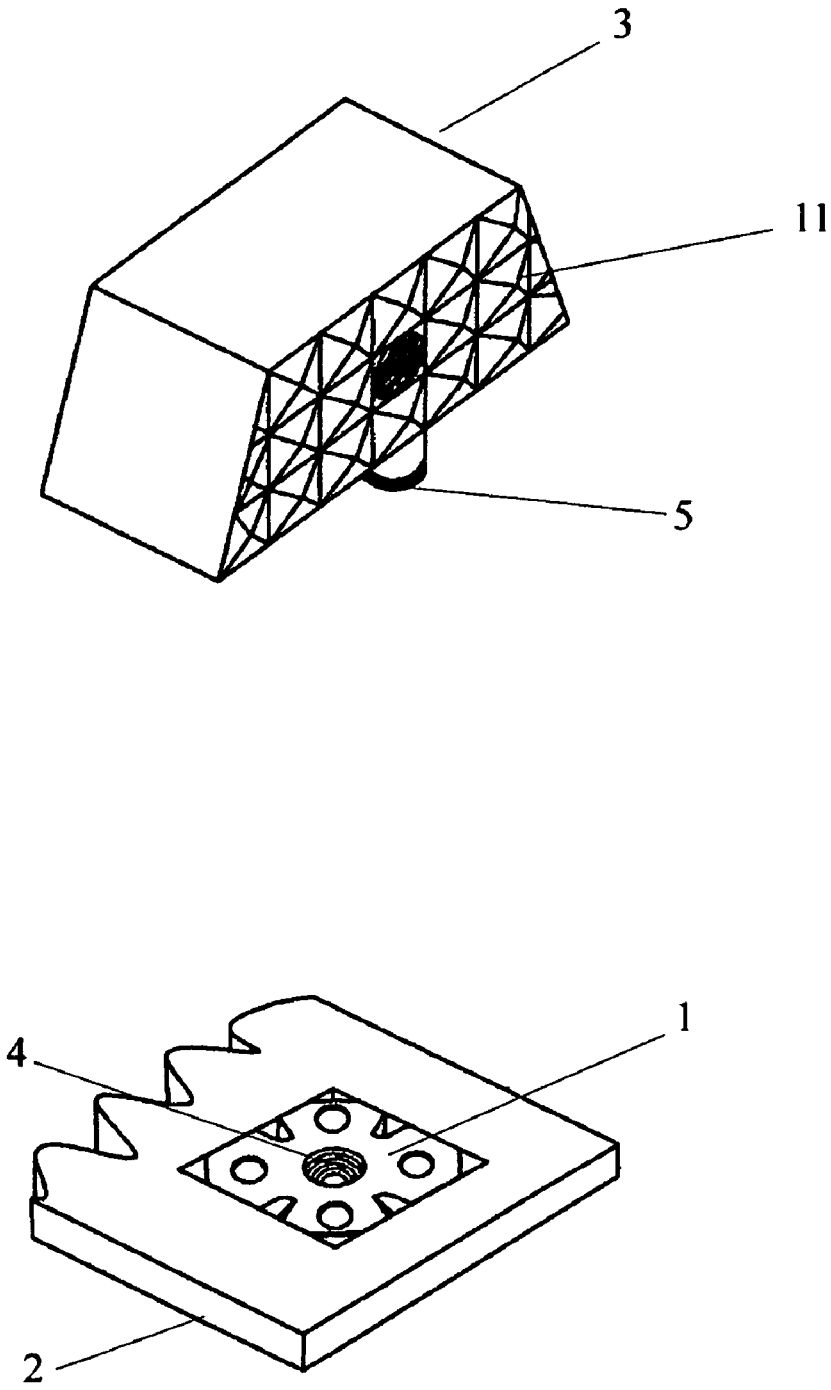
FIG. 2 is a view from above of the female-threaded insert (1) located in the base of the sole (2) and of the side support (3) with threaded pin (5) before this is screwed into the cavity (4) of the threaded insert (1)
Figure 3:
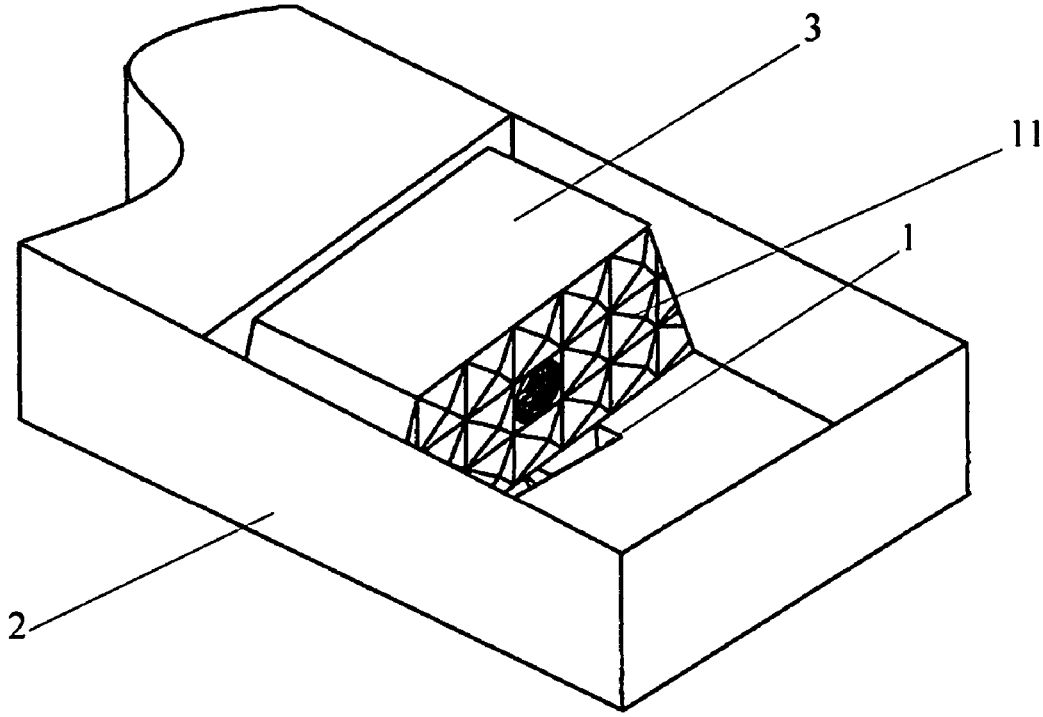
FIG. 3 is a view from above of the female-threaded insert (1) and of the side support (3) assembled inside the base (2)
Figure 4:
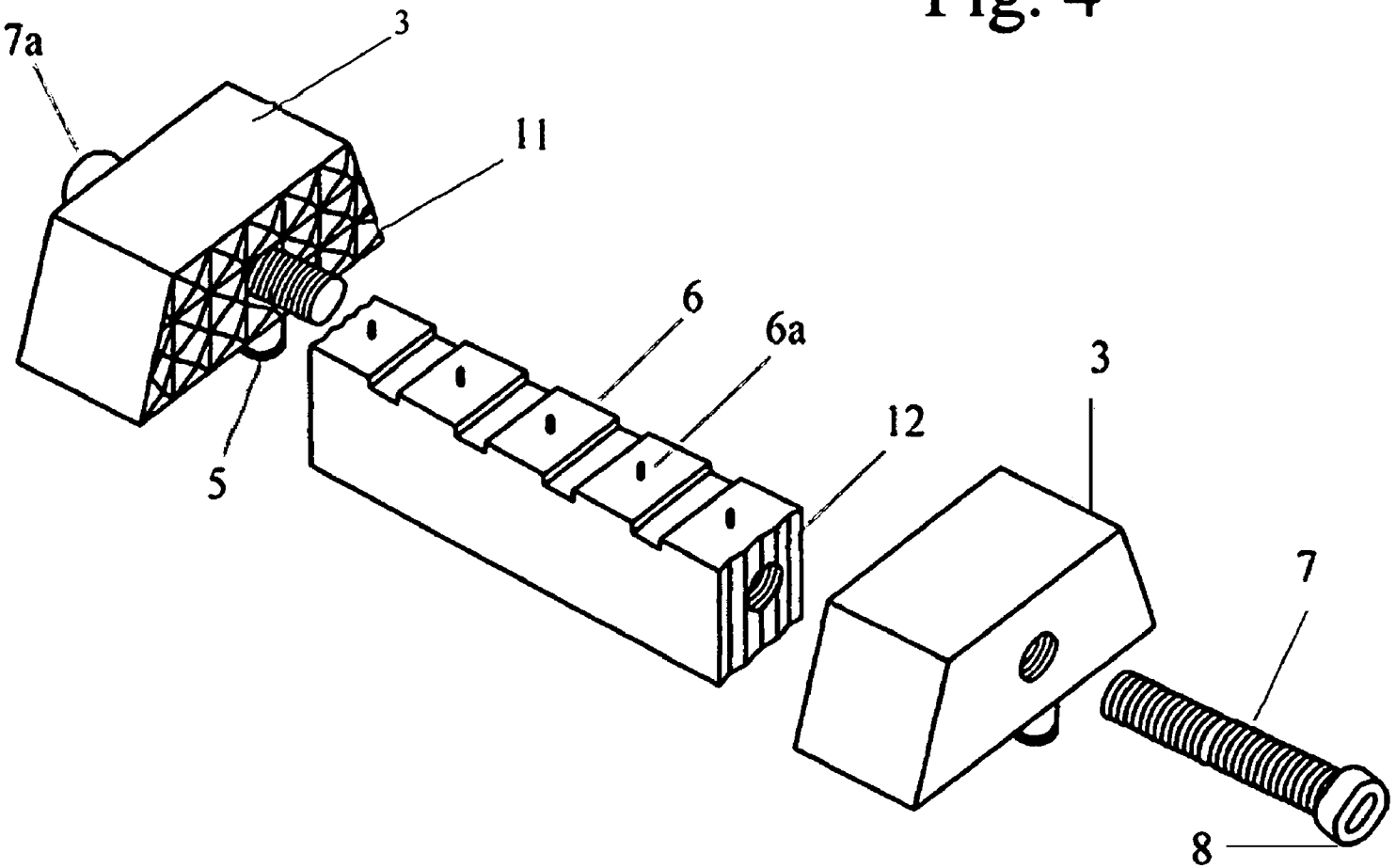
FIG. 4 is an actual view of the anti-slip device with its elements composed of two side supports (3) to which the rotating element (6), shown with its serrated part (6*a*) turned towards the ground, is screwed and unscrewed with a threaded screw (7)
Figure 5:
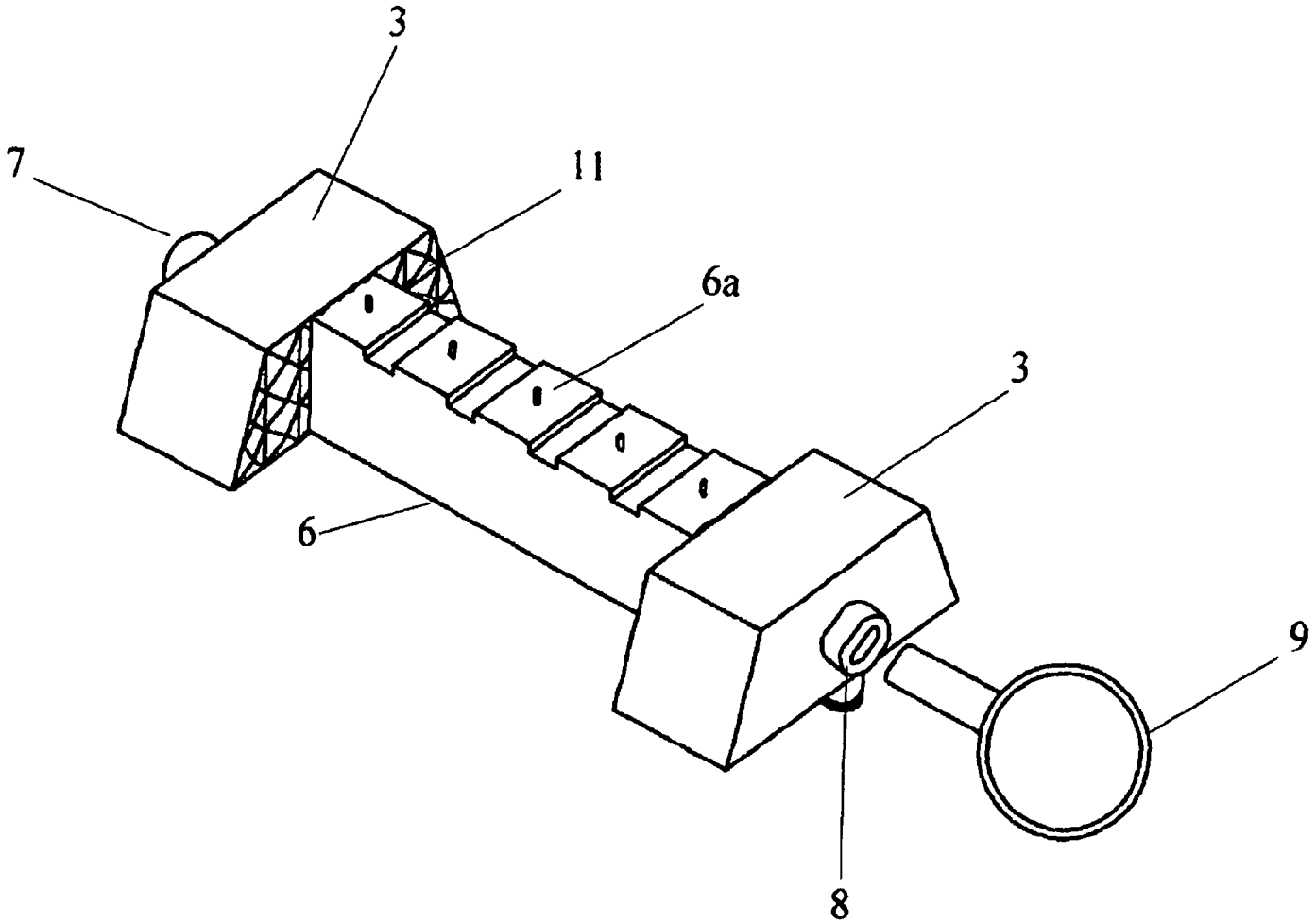
FIG. 5 is a view from above of the anti-slip device whose rotating element (6) may be screwed or unscrewed from its two side supports (3) with the threaded screw (7) characterized in its external part by a female cavity (8) into which the key (9) is inserted so as to allow rotation through the unscrewing and screwing down of the rotating element (6) according to the conditions of the ground.
Figure 6:
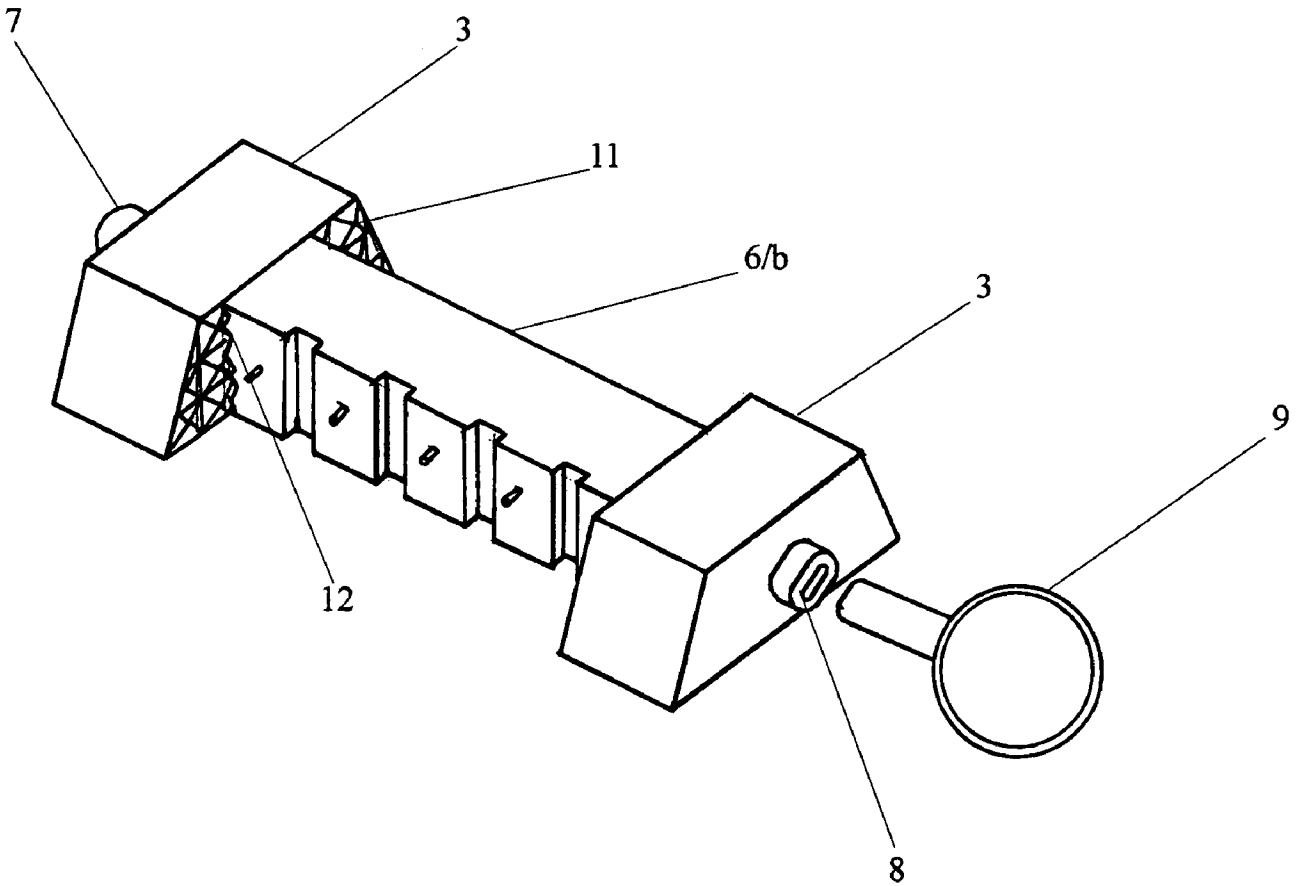
FIG. 6 is a view from above of the anti-slip device whose rotating element (6) is screwed to its two side supports (3) with its smooth part (6*b*) in line with the side support (3) and turned towards the ground if this is not covered in snow or ice.

FIG. 7 shows the sole fitted with the anti-slip device that is the object of the present application in two or more elements, preferably three as described, both in the anti-slip version with the serrated part (6*a*) turned towards the ground, and in the normal version with the smooth part (6*b*) of the rotating element (6) turned towards the ground, the whole being adjustable with the key (9) for screwing and unscrewing the rotating element (6) from its side supports (3);

FIG. 8 shows the shoe upper on which the pocket (10) is designed to hold the key (9), which is supplied with the anti-slip footwear.

The invention in the present application consists of a device composed of the combination of a set of elements that, joined by means of screws, give the user the possibility of being able to adapt easily his or her footwear with anti-slip nails in the present of snow or ice on the paved surface.

The device that is the subject of the present application comprises a female-threaded metal insert (1), two for each rotating element (6), which are fixed to the base of a sole (2).

Each female-threaded metal insert (1) is equipped with a threaded cavity (4) to which a side support (3) is anchored, two for each rotating element (6), by means of a threaded pin (5). The surface (11) of the two side supports (3) and the surface (12) of the rotating element (6) designed to fit together are knurled or in any case worked so as to obtain a blocking effect of the rotating element (6) on the two side supports (3) once this element has been screwed down in the phase preselected by means of the key (9).

Another characteristic of the two side supports (3) is that their profile, once they have been screwed to the metal inserts (1), corresponds to that of the sole.

The rotating element (6) equipped with a smooth part (6*b*), in line with the profile of the sole, to be used when the paved surface is in normal conditions or, alternatively, by a serrated part with nails (6*a*) if the paved surface is covered with snow or ice, is screwed to the two side supports (3).

In the case of snow or ice, the present invention allows the user, by means of a key (9), to be able to rotate towards the ground the serrated nailed part 6*a*) of the rotating element (6) with the operation of unscrewing this from its two side supports (3).

The key (9) is supplied together with the footwear as an accessory and may be housed in a special container (10) provided in the upper.

The device described above can be inserted in any sole for footwear with one or more rotating elements (6), preferably three as described in the present application, depending on the shoe or the needs of the user.

The materials and the dimensions of the invention as described above, illustrated in the attached drawings and claimed below, may be any, depending on requirements. In addition, all the details may be substituted with others that are technically equivalent, without going outside the protective environment of the present patent application for invention.

The invention claimed is:

1. An anti-slip apparatus comprising:

a shoe having a sole;

a first metal insert affixed to said sole;

a second metal insert affixed to said sole in spaced relation to said first metal insert;

a first side support having a threaded pin extending therefrom, said threaded pin anchored to said first metal insert;

a second side support having a threaded pin extending therefrom, said threaded pin of said second support anchored to said second metal insert; and a rotating element affixed to said first side support and said second side support, said rotating element having a smooth surface on one side thereof and a serrated surface formed on another side thereof, said rotating element being rotatable such that one of said smooth surface and said serrated surface face downwardly from said sole, said sole having a slot formed therein, said first and second side supports positioned in said slot such that a surface of said first and second side supports is coplanar with a bottom surface of said sole.

2. The anti-slip apparatus of claim 1, each of said first and second metal inserts having a threaded cavity, the threaded pins of said first and second side supports being respectively threadedly received in the threaded cavities of said first and second metal inserts.

3. The anti-slip apparatus of claim 1, said rotating element connected to at least one of said first and second side supports by a threaded screw.

4. The anti-slip apparatus of claim 3, said rotating element having a threaded cavity at least one end thereof, said threaded cavity threadedly receiving said threaded screw therein.

5. The anti-slip apparatus of claim 4, said rotating element being rotatable with respect to said threaded screw such that rotatable element is movable between a first position in which said smooth surface faces downwardly from said sole and a second position in which said serrated surface faces downwardly or said sole.

6. The anti-slip apparatus of claim 5, further comprising:

a key releasably engageable with said rotating element so as to move said rotating element between said first and second position.

7. The anti-slip apparatus of claim 6, said rotating element being fixed in one of said first and second positions.

* * * * *